US008277012B2

(12) United States Patent
Kawai et al.

(10) Patent No.: US 8,277,012 B2
(45) Date of Patent: Oct. 2, 2012

(54) RECORDING APPARATUS

(75) Inventors: Koji Kawai, Ichinomiya (JP); Yoshiharu Furuhata, Nagoya (JP); Naoto Iwao, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 213 days.

(21) Appl. No.: 12/721,142

(22) Filed: Mar. 10, 2010

(65) Prior Publication Data

US 2010/0245434 A1 Sep. 30, 2010

(30) Foreign Application Priority Data

Mar. 30, 2009 (JP) ..... 2009-081549

(51) Int. Cl.

| | |
|---|---|
| ***B41J 29/38*** | (2006.01) |
| ***B41J 29/393*** | (2006.01) |
| ***B41J 2/21*** | (2006.01) |
| ***B41J 2/175*** | (2006.01) |
| ***B41J 2/01*** | (2006.01) |

(52) U.S. Cl. ..... 347/14; 347/16; 347/19; 347/43; 347/86; 347/102

(58) Field of Classification Search ..... None
See application file for complete search history.

(56) References Cited

U.S. PATENT DOCUMENTS

| | | | | |
|---|---|---|---|---|
| 6,502,916 | B1 * | 1/2003 | Naka | 347/14 |
| 7,364,249 | B2 | 4/2008 | Uji et al. | |
| 2005/0270322 | A1 | 12/2005 | Uji et al. | |
| 2006/0061617 | A1 | 3/2006 | Udagawa | |
| 2007/0229559 | A1 * | 10/2007 | Oku | 347/9 |
| 2009/0027435 | A1 * | 1/2009 | Katada | 347/14 |

FOREIGN PATENT DOCUMENTS

| | | |
|---|---|---|
| JP | 10-230621 | 9/1998 |
| JP | 2003-39703 A | 2/2003 |
| JP | 2005-349607 A | 12/2005 |
| JP | 2006-88413 | 4/2006 |
| JP | 2007-136722 | 6/2007 |
| JP | 2008-23759 | 2/2008 |
| JP | 2008-80740 A | 4/2008 |

OTHER PUBLICATIONS

Notification of Reasons for Refusal dated Jan. 18, 2011 together with partial English translation.

* cited by examiner

*Primary Examiner* — Stephen Meier
*Assistant Examiner* — Alexander C Witkowski
(74) *Attorney, Agent, or Firm* — Scully, Scott, Murphy & Presser, PC

(57) ABSTRACT

A conveyance unit continually conveys sheets of the number of continual prints. A head control section controls ejection of ink droplets from inkjet heads in such a way that there are produced image dots which make up an image to be printed on each of the sheet every time the sheet is conveyed and flushing dots corresponding to flushing dot candidates, among flushing dot candidates for flushing patterns included in a flushing pattern group determined from the continual print count, which are placed at locations where the image dots are not to be produced.

16 Claims, 12 Drawing Sheets

RECORDING APPARATUS

CROSS REFERENCE TO RELATED APPLICATION

The present application claims priority from Japanese Patent Application NO. 2009-081549, which was filed on Mar. 30, 2009, the disclosure of which is incorporated herein by reference in its entirety.

BACKGROUND

The present invention relates to a recording apparatus having a liquid ejection head for ejecting a liquid.

A plurality of nozzles for ejecting ink droplets to a recording medium, such as a print sheet, are formed in an inkjet head provided in an inkjet printer. In such an inkjet head, viscosity of ink in the nozzles increases with elapse of a time, thereby sometimes causing a change in an ink ejection characteristic and an ejection failure. A hitherto known technique for preventing them is to produce flushing dots in an area other than an area where an image to be printed on a recording medium is produced, in such a way that all nozzles eject ink droplets to the recording medium every time a predetermined period elapses. An increase in the viscosity of the ink in the nozzles can thereby be prevented without wasting the recording medium.

SUMMARY

According to the foregoing technique, when a plurality of recording mediums undergo continual printing, flushing dots are formed on a specific recording medium. Hence, print quality of only the recording mediums on which flushing dots are formed is deteriorated.

An object of the present invention is to provide a recording apparatus that makes recording quality of recording mediums uniform while preventing occurrence of an increase in viscosity of a liquid in ejection ports without wastefully consuming a recording medium.

In order to achieve the object, an aspect of the invention provides a recording apparatus comprising:

a conveyance mechanism which conveys a recording medium in a conveyance direction;

a liquid ejection head including a plurality of ejection ports that eject droplets to the recording medium conveyed by the conveyance mechanism;

a drive data storage which stores drive data for allocating, to the plurality of ejection ports, amounts of liquids to be ejected for producing an image on the recording medium every recording cycle which is a time required to convey by the conveyance mechanism the recording medium by a unit distance commensurate with a print resolution of the recording medium in the conveyance direction;

a record count storage which stores a record count that is number of recording mediums on which images are to be produced by the liquid ejection head;

a conveyance controller which controls the conveyance mechanism in such a way that recording mediums equal in number to the record count stored in the record count storage are continually conveyed; and a head controller which controls ejection of liquid from the liquid ejection head in accordance with the drive data stored in the drive data storage in such a way that one or a plurality of image dots, which makes up the image, are formed on the recording mediums conveyed by the conveyance mechanism, and which controls ejection of liquid from the liquid ejection head in such a way that a flushing dot which does not make up the image is formed on at least one position in an area of the recording mediums and each of the plurality of ejection ports produces at least one image dot or flushing dot before recording on the recording mediums of a predetermined number or less is completed, wherein the predetermined number is equal to or smaller than a maximum number of recording mediums that are conveyed by the conveyance mechanism within a period of time during which speed of droplets ejected from the ejection ports reduces from a standard speed to a predetermined percentage of the standard speed as a result of degradation of liquid in the ejection ports.

Another aspect of the present invention provides a recording apparatus comprising:

an image data storage section which stores image data;

a flushing data storage section which stores a plurality of flushing pattern groups which have different flushing patterns from each other;

a continual print count storage section stores a continual print count that is number of recording mediums on which images are to be produced by the liquid ejection head; and a controller which selects at least one of the flushing pattern groups stored in the flushing data storage section according to the continual print count stored in the continual print count storage, and controls a printing head to eject ink droplets based on the image data stored in the image data storage and the selected at least one of the flushing pattern groups.

DESCRIPTION OF EXEMPLARY EMBODIMENTS

A preferred embodiment of the present invention is hereunder described by reference to the drawings.

Figure 1:
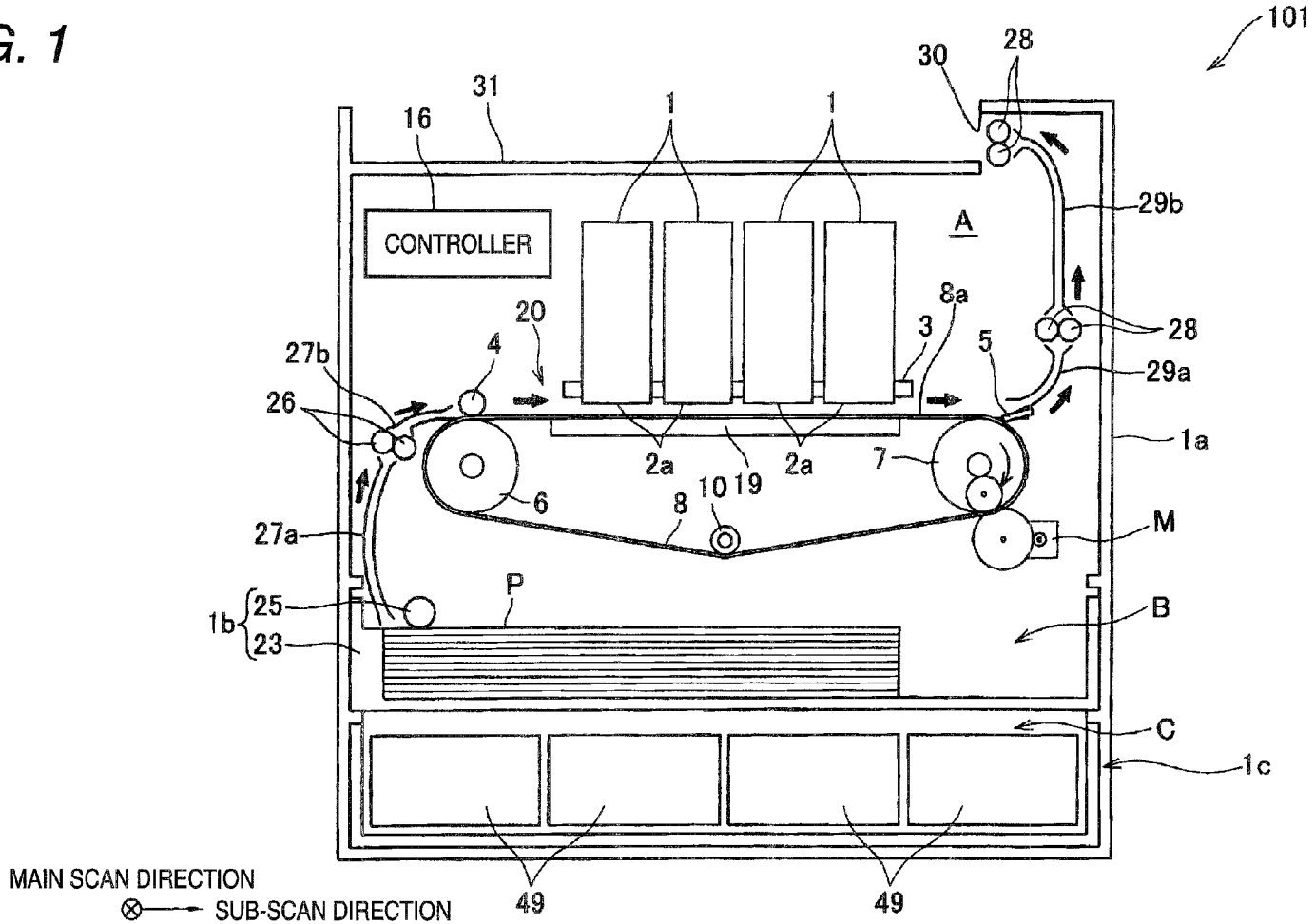
FIG. 1 is a cross sectional view of an inkjet printer of an embodiment of the present invention.

As shown in FIG. 1, an inkjet printer 101 includes a parallelepiped housing 1*a*. A sheet output section 31 is provided in an upper portion of the housing 1*a*. An interior of the housing 1*a* is divided, in sequence from top, three spaces A, B, and C. Four inkjet heads 1 that respectively eject magenta ink, cyan ink, yellow ink, and black ink and a conveyance, unit 20 are arranged in the space A. A sheet feed unit 1*b* removably attached to the housing 1*a* is disposed in the space B, and an ink tank unit 1*c* is disposed in the space C. In the embodiment, a sub-scan direction is a direction parallel to the conveyance direction in which a conveyance unit 20 conveys a sheet P. A main scan direction is a direction that is orthogonal to the sub-scan direction and that is aligned to a horizontal plane.

A sheet conveyance path along which the sheet P is to be conveyed from the sheet feed unit 1*b* to the sheet output section 31 is formed in the inkjet printer 101 (as designated by an arrow of medium width shown in FIG. 1). The sheet feed unit 1*b* includes a sheet feed tray 23 capable of housing a plurality of sheets P and a sheet feed roller 25 attached to the sheet feed tray 23. The sheet feed roller 25 feeds the topmost sheet P among a plurality of sheets P stocked in a piled manner in the sheet feed tray 23. The sheet P fed by the sheet feed roller 25 is fed to the conveyance unit 20 while being guided by guides 27*a* and 27*b* and nipped between a pair of feed rollers 26.

The conveyance unit 20 includes two belt rollers 6 and 7; an endless conveyance belt 8 wrapped around the rollers so as to extend between the rollers 6 and 7; and a tension roller 10. The tension roller 10 is downwardly forced while remaining in contact with an internal peripheral surface of a lower loop of the conveyance belt 8, to thus impart tension to the conveyance belt 8. The belt roller 7 is a drive roller and rotated in a clockwise direction in FIG. 1 when imparted with drive force from a conveyance motor M through two gears. The belt roller 6 is a driven roller and rotated by rotation of the belt roller 7 in the clockwise direction in FIG. 1 along with travel of the conveyance belt 8.

An outer peripheral surface 8*a* of the conveyance belt 8 is subjected to silicon treatment and exhibits adhesiveness. A nip roller 4 is disposed at a position along the sheet conveyance path so as to oppose the belt roller 6 with the conveyance belt 8 sandwiched therebetween. The nip roller 4 presses the sheet P fed out of the sheet feed unit 1*b* against the outer peripheral surface 8*a* of the conveyance belt 8. The sheet P pressed against the outer peripheral surface 8*a* is conveyed in a rightward direction in FIG. 1 while held on the outer peripheral surface 8*a* by means of adhesiveness of the outer peripheral surface.

A separation plate 5 is disposed at a position on the sheet conveyance path where the separation plate opposes the belt roller 7 with the conveyance belt 8 sandwiched therebetween. The separation plate 5 separates the sheet P from the outer peripheral surface 8*a*. The thus-separated sheet P is conveyed while guided by guides 29*a* and 29*b* and nipped by two feed roller pairs 28 and output to the sheet output section 31 from an opening 30 formed in the upper portion of the housing 1*a*.

Four inkjet heads 1 are supported by the housing 1*a* through a frame 3. The four inkjet heads 1 extend along the main scan direction and are arranged in parallel to each other along the sub-scan direction. The inkjet printer 101 is a line-type color inkjet printer in which an ejection area extending in the main scan direction is formed. A lower surface of each of the inkjet heads 1 is an ejection surface 2*a* through which ink droplets are ejected.

A platen 19 is arranged in the loop of the conveyance belt 8 and is opposed to the four inkjet heads 1. An upper surface of the platen 19 remains in contact with an internal peripheral surface of an upper loop of the conveyance belt 8 and supports the conveyance belt 8 from its inner peripheral side. The outer peripheral surface 8*a* of the upper loop of the conveyance belt 8 is opposed the lower surfaces of the inkjet heads 1, namely, the ejection surfaces 2*a*, in parallel to each other, whereby clearance of predetermined interval suitable for producing an image is created. The clearance makes up a portion of the sheet conveyance path. When the sheet P conveyed by the conveyance belt 8 passes by positions located immediately below the respective heads 1, respective colors of ink are sequentially ejected toward an upper surface of the sheet P from the respective heads 1, whereupon a desired color image is produced on the sheet P.

The respective inkjet heads 1 are connected to respective ink tanks 49 set in the ink tank unit 1*c* provided in the space C. The four ink tanks 49 store ink to be ejected by the corresponding ink jet heads 1, respectively. Ink is supplied from each of the ink tanks 49 to the corresponding inkjet head 1 through a tube (not shown), or the like.

The inkjet heads 1 are now described in detail by reference to FIGS. 2 and 3. A lower housing 82 is omitted from FIG. 3.

Figure 2:
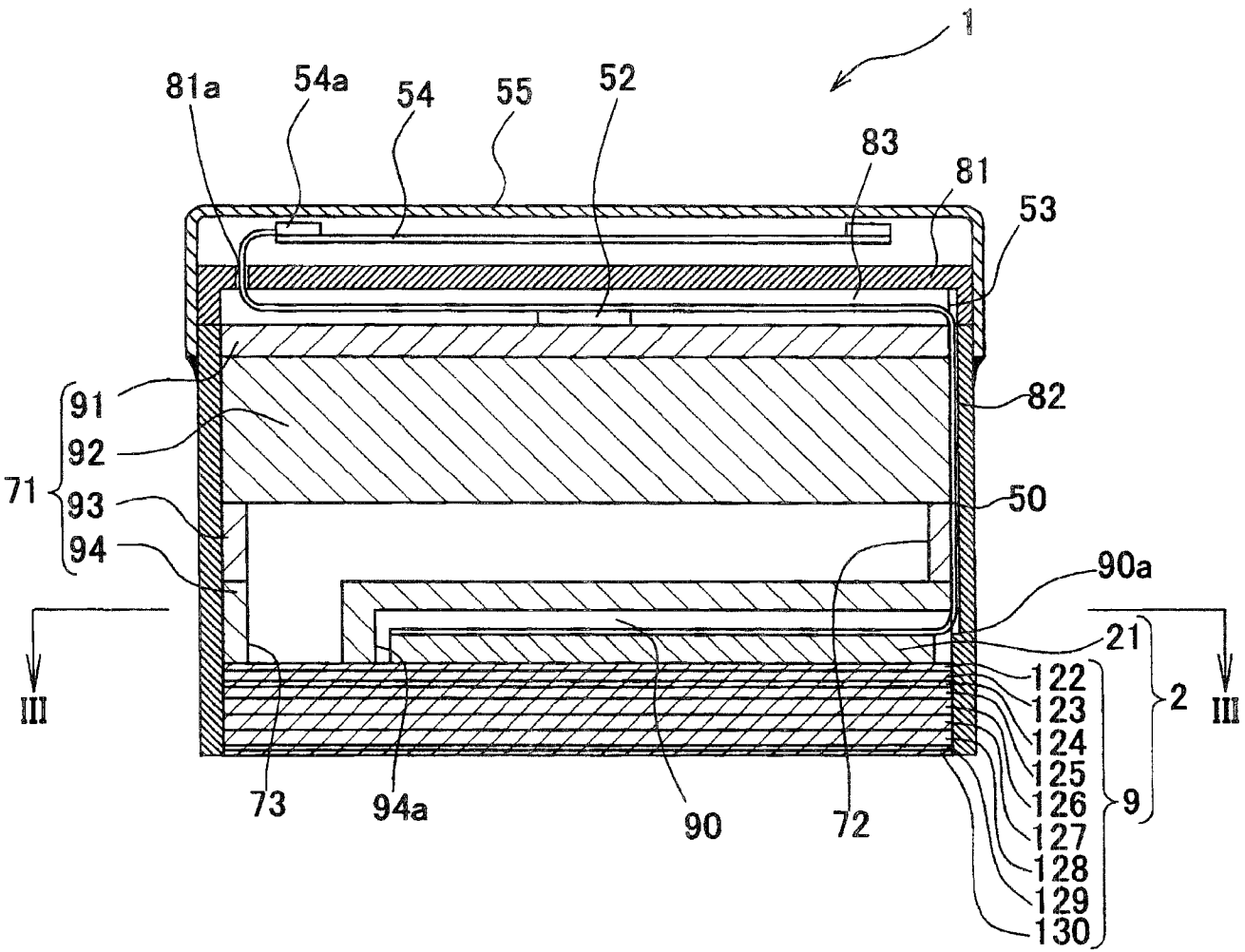
FIG. 2 is a cross sectional view of the inkjet head shown in FIG. 1 taken along its widthwise direction.

As shown in FIG. 2, each of the inkjet heads 1 includes a reservoir unit 71; a head main body 2 including a flow channel unit 9 and an actuator unit 21; and a COF (Chip On Film: a flat flexible substrate) 50 that is connected at its one end to the actuator unit 21 and that is equipped with a driver IC 52; and a control substrate 54 to which the other end of the COF 50 is connected. The inkjet head 1 includes the reservoir unit 71; an upper housing 81 and the lower housing 82 that make up a box surrounding the flow channel unit 9; and a head cover 55 that encloses the control substrate 54 at a position above the upper housing 81.

The reservoir unit 71 is a flow channel formation member that is fixed to an upper surface of the head main body 2 and that supplies the head main body 2 with ink. The reservoir unit 71 is a multilayered substance formed by stacking four mutually-positioned plates 91 to 94. An unillustrated ink inflow channel, the ink reservoir 72, and ten ink outflow channels 73 are formed in the reservoir unit so as to mutually communicate with each other. Only one of the ink outflow channels 73 is shown in FIG. 2. The ink inflow channel is a channel into which ink flows from the ink tank 49. The ink reservoir 72 temporarily stores an inflow of ink from the ink inflow channel. The ink outflow channel 73 is a flow channel through which ink flows from the ink reservoir 72 and that is in mutual communication with an ink supply port 105*b* formed in an upper surface of the flow channel unit 9. Ink from the ink tank 49 flows into the ink reservoir 72 through the ink inflow channel, passes through the ink outflow channel 73, and is supplied from the ink supply port 105*b* to the flow channel unit 9.

An indentation 94*a* is formed in a lower surface of the plate 94. The indentation 94 creates clearance 90 between the lower surface of the plate and an upper surface of the flow channel unit 9. The four actuator units 21 on the flow channel unit 9 are arranged at equal intervals in the clearance 90 along the longitudinal direction of the flow channel unit 9. In a side surface of the multilayered substance, four openings 90*a* of the clearance 90 are formed at equal intervals in a staggered pattern and along the longitudinal direction of the reservoir unit 71.

Protuberances (areas other than the indentation 94*a*) on the lower surface of the plate 94 are adhered to the flow channel unit 9. The ink outflow channels 73 are formed in the respective protuberances.

A neighborhood of one end of the individual COF 50 is connected to an upper surface of the corresponding actuator unit 21. The COF 50 extends from the upper surface of the actuator unit 21 in a horizontal direction and passes through the opening 90*a*. The COF thus passed through the opening is then curved and bent at substantially right angles in an upward direction. The thus-bent COF passes through a cutout 53 formed in an interior wall surface of the upper housing 81 and the lower housing 82 and is pulled to a position above the reservoir unit 71. The COF 50 further extends in a leftward direction in FIG. 2 at a position above the reservoir unit 71 and pulled to a position above the upper housing 81 through a slit 86*a* formed in the upper housing 81. The other end of the COF 50 is connected to the corresponding control substrate 54 through a connector 54*a* at a position above the upper housing 81. A driver IC 52 is mounted at an arbitrary position on the COF 50. The driver IC 52 is affixed to the upper surface of the reservoir unit 71 and thermally coupled to the reservoir unit 71. Heat given off by the driver IC 52 thereby propagates to the reservoir unit 71, whereupon the driver IC 52 is cooled. On the other hand, ink in the reservoir unit 71 is heated, to thus hinder an increase in viscosity of ink.

The control substrate 54 is placed at a position above the upper housing 81 and controls actuation of the actuator unit 21 through the driver IC 52 of the COF 50. The driver IC 52 is for generating a drive signal for actuating the actuator unit 21.

The head main body 2 is now described with reference to FIGS. 3 and 4. Pressure chambers 110, apertures 112, and ejection ports 108, which are located beneath the actuator unit 21 and which are to be drawn in broken lines, are drawn in solid lines in FIG. 4 for the sake of explanation.

Figure 3:
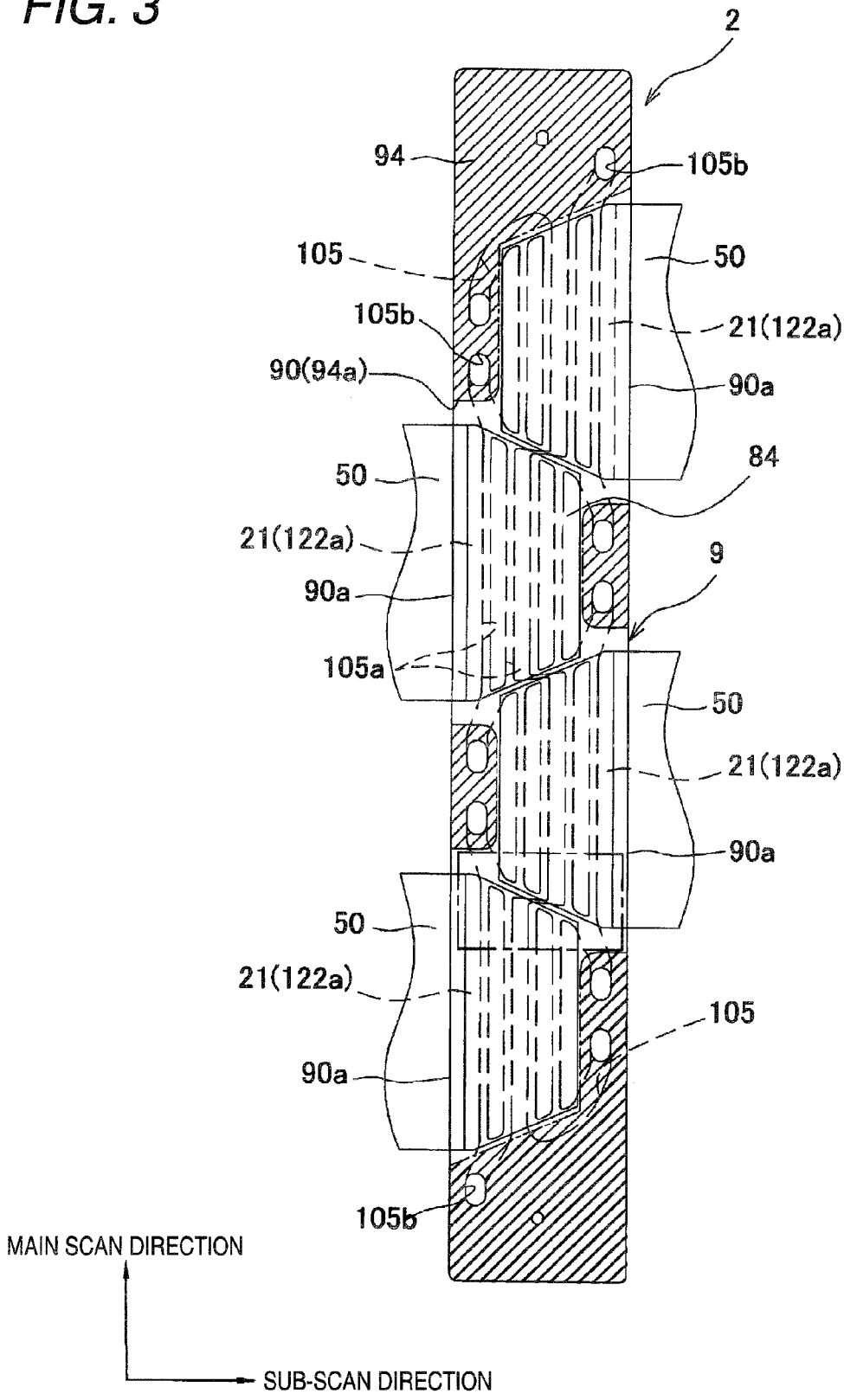
FIG. 3 is a cross sectional view taken along line III-III shown in FIG. 2.
Figure 4:
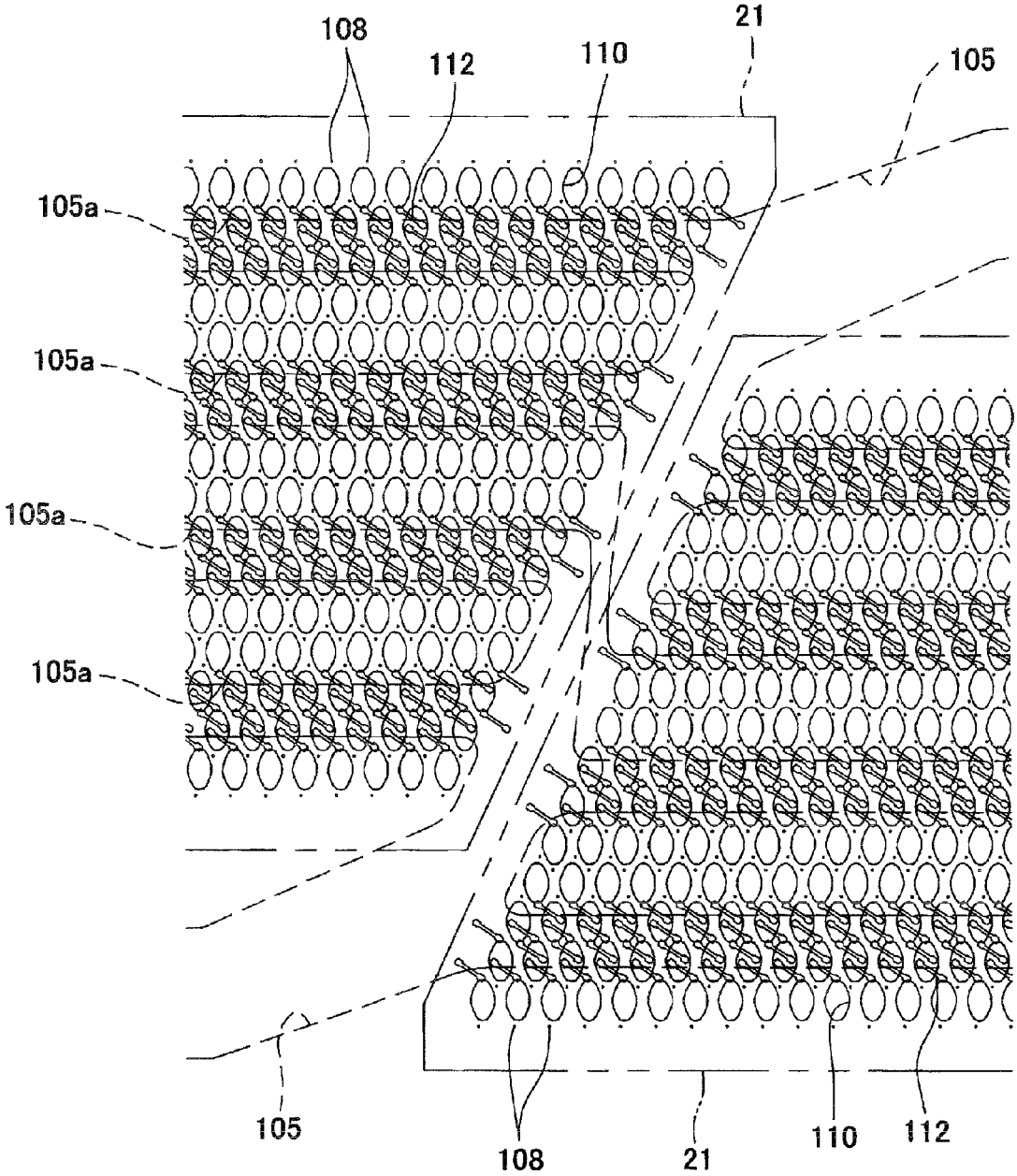
FIG. 4 is an enlarged view of an area enclosed by a dashed line shown in FIG. 3.

As shown in FIG. 3, the head main body 2 is a multilayered substance in which the four actuator units 21 are fixed to the upper surface 9*a* of the flow channel unit 9. As shown in FIGS. 3 and 4, ink flow channels, including the pressure chambers 110, are formed in the flow channel unit 9. Each of the actuator units 21 includes a plurality of actuators assigned to the respective pressure chambers 110 and has a function of selectively imparting ejection energy to ink stored in the respective pressure chambers 110.

The flow channel unit 9 assumes the shape of a rectangular parallelepiped having substantially the same planar shape as that of the plate 94 of the reservoir unit 71. A total of ten ink supply ports 105*b* are formed in the upper surface 9*a* of the flow channel unit 9 in correspondence with the ink outflow channels 73 of the reservoir unit 71 (see FIG. 2). As shown in FIG. 3, there are formed in the flow channel unit 9 a manifold flow channel 105 remaining in mutual communication with the ink supply ports 105*b*, a sub-manifold 105*a* branched off from the manifold flow channel 105, and a plurality of individual ink flow channels branched off from the sub-manifold flow channel 105*a*. As shown in FIG. 1, the ejection surfaces 2*a* are formed on a lower surface of the flow channel unit 9, and as shown in FIG. 4, the plurality of ejection ports 108 are arranged in the ejection surfaces in a matrix pattern.

In the embodiment, sixteen rows of the pressure chambers 110 that are equally spaced along the longitudinal direction of the flow channel unit 9 are arranged in parallel to each other along a widthwise direction. The number of pressure chambers 110 included in each of the rows of pressure chambers becomes gradually smaller from a long side (a lower bottom side) to a short side (an upper bottom side) in correspondence with the outer shape (a trapezoidal shape) of the actuator unit 21 to be described later. The ejection ports 108 are also arranged correspondingly to the pressure chambers.

The flow channel unit 9 is a multilayered substance made by mutually positioning a plurality of metal plates made of stainless steel. Channels extending from the manifold flow channel 105 to the ejection ports 108 through the pressure chambers 110 are formed in the flow channel unit 9.

Ink flow in the flow channel unit 9 is now described. As shown in FIGS. 3 and 4, the ink supplied from the reservoir unit 71 into the flow channel unit 9 through the ink supply port 105*b* is distributed from the manifold flow channel 105 to the sub-manifold flow channels 105*a*. The ink in the sub-manifold flow channels 105*a* flows into the individual ink flow channels and reaches the ejection ports 108 through the pressure chambers 110.

The actuator units 21 are unimorph actuators. The unimorph actuator includes lead zirconate titanate (PZT)-based piezoelectric sheet made of ceramic exhibiting ferroelectricity. Upon receipt of an input of a drive signal, the actuator unit 21 selectively imparts pressure (ejection energy) to the ink in a target pressure chamber 110, thereby ejecting an ink droplet from the corresponding ejection port 108.

Figure 5:
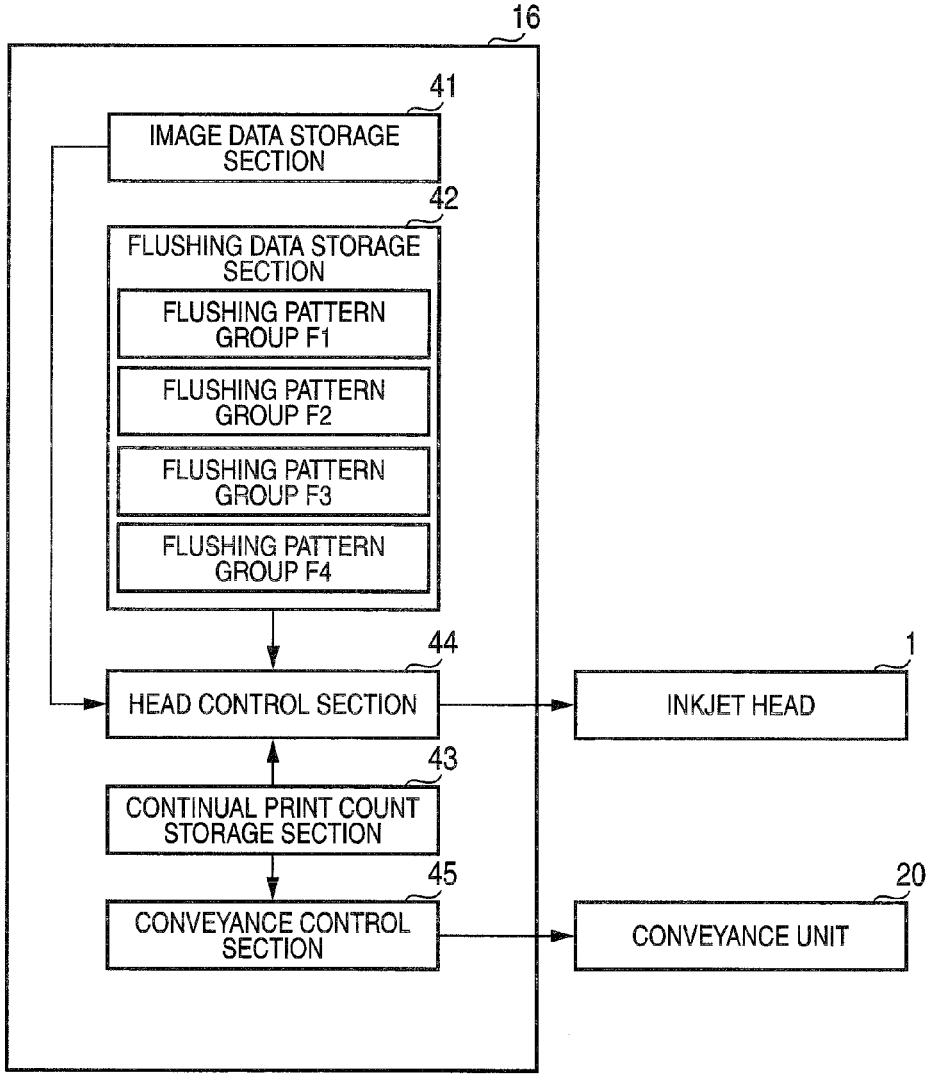
FIG. 5 is a functional block diagram of a controller shown in FIG. 1.

The controller 16 is now described by reference to FIG. 5. The controller 16 includes a CPU (Central Processing Unit); EEPROM (Electrically Erasable and Programmable Read Only Memory) that rewritably stores a program to be executed by the CPU and data used for the program; and RAM (Random Access Memory) that temporarily stores data at the time of execution of the program. Respective operation parts making up the controller 16 are built as a result of these hardware parts and software in the EEPROM acting synergistically. As shown in FIG. 5, the controller 16 controls the entirety of the inkjet printer 101 and includes an image data storage section 41, a flushing data storage section 42, a continual print count storage section 43, a head control section 44, and a conveyance control section 45.

The image data storage section 41 stores image data (drive data) pertaining to an image to be printed on the sheet P. The image data are for allocating a volume of ink droplet to be ejected to each of the ejection ports 108 of the respective inkjet heads every print cycle. Ink droplets are ejected in accordance with the data, whereby image dots making up a desired image are produced on the sheet P. The print cycle corresponds to a period of time required to convey the sheet P over only a unit distance commensurate with a print resolution for the conveyance direction of the sheet P. Ink droplets to be ejected from the ejection ports 108 for producing the image dots in the present embodiment correspond to any selected from ink droplets having three types of volumes of ink droplets (large ink droplets, medium ink droplets, and small ink droplets). The image data represent positions of image dots, which are to be produced on the sheet P, within a virtual sheet P' (see FIGS. 6 through 9) that represents the sheet P in a data space and that includes a plurality of pixels arranged in a matrix pattern in both the main scan direction and the conveyance direction of the sheet P.

The flushing data storage section 42 stores, for each color, flushing data pertaining to a flushing pattern drawn on the sheet P in flushing dots. The flushing data are for commanding whether or not to eject ink droplets for flushing in relation to the respective ejection ports 108 of the respective inkjet heads. Ink droplets are ejected in accordance with the data, whereupon flushing dots arranged in a flushing pattern are produced on the sheet P. The flushing data include data pertaining to a plurality of flushing patterns. The flushing pattern includes a plurality of flushing dot candidates capable of producing flushing dots and corresponds to an arrangement pattern of flushing dots on the sheet P. The flushing data specifically show positions of the flushing dot candidates on the virtual sheet P'.

The flushing pattern of the flushing data stored in the flushing data storage section 42 is described in detail with further reference to FIGS. 6 through 9. FIGS. 6 to 9 illustrate flushing patterns for a case where twenty-four ejection ports 108 of the inkjet head 1 are arranged in the main scan direction. The twenty-four ejection ports 108 are sequentially arranged at uniform intervals along the sub-scan direction, as well as being arranged at predetermined uniform intervals along the main scan direction. The ejection ports are collected in groups each including four ejection ports. Further, the respective ejection ports 108 are arranged as a whole in such a way that the positions of every fourth ejection port are the same in the sub-scan direction. Six ejection ports 108 selected from every fourth ejection port from one end in the main scan direction are taken as one group, and four ejection port groups G1 to G4 are formed. The respective ejection port groups G1 to G4 are offset from each other at predetermined uniform intervals in the main scan direction.

Dots K in the drawings depict flushing dot candidates pertaining to the ejection ports 108 of the black inkjet head 1. Dots M in the drawings depict flushing dot candidates pertaining to the ejection ports 108 of the magenta inkjet head 1. Dots C in the drawings depict flushing dot candidates pertaining to the ejection ports 108 of the cyan inkjet head 1. Dots Y in the drawings depict flushing dot candidates pertaining to the ejection ports 108 of the yellow inkjet head 1.

Figure 6:
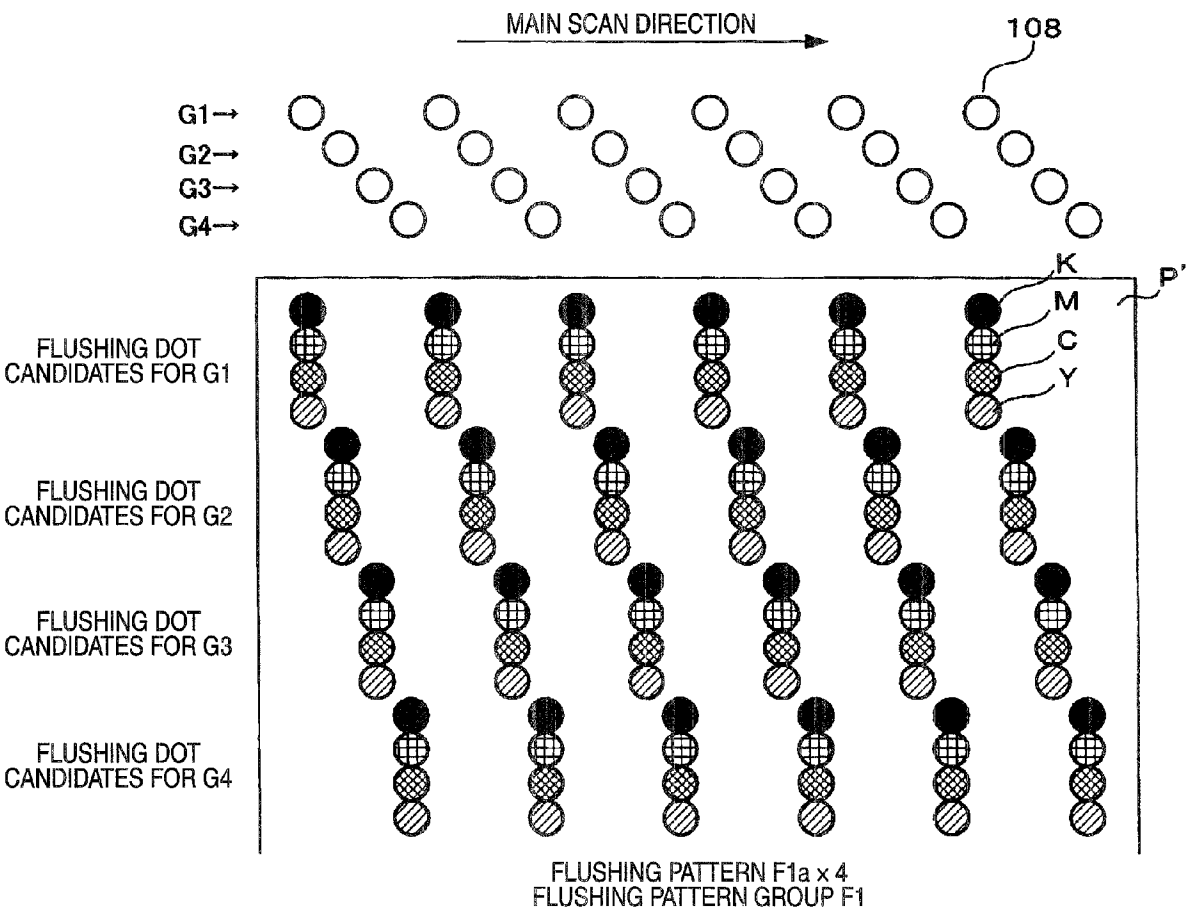
FIG. 6 is a schematic view of a bottom area representing a flushing pattern stored in a flushing data storage section shown in FIG. 5.

As shown in FIG. 5, the flushing data storage section 42 stores four flushing pattern groups F1 to F4 included in the flushing data pertaining to each of the inkjet heads 1. As shown in FIG. 6, the flushing pattern group F1 includes one flushing pattern F1*a* for each of the inkjet heads 1. FIG. 6 shows flushing patterns F1*a* for the respective inkjet heads 1 that are superimposed on each other.

In the flushing pattern F1*a* for each of the inkjet heads 1, the flushing dot candidates corresponding to the ejection ports 108 belonging to a single ejection port group G1 to G4 are arranged on the virtual sheet P' along the main scan direction, thereby making up one row. Four rows of the flushing dot candidates corresponding to the respective four ejection port groups G1 to G4 are sequentially arranged from up to down in the drawing while being offset from each other in the main scan direction. Rows of flushing dot candidates belonging to the same ejection port groups G1 to G4 of the four inkjet heads 1 are arranged in the conveyance direction of the sheet P (the sub-scan direction). Sequence of arrangement of four rows is black, magenta, cyan, and yellow in sequence from up to down in the drawing. Specifically, four flushing dot candidates corresponding to the ejection ports 108 located at the same location with respect to the main scan direction of each of the inkjet heads 1 are placed at mutually different positions in the conveyance direction of the sheet P while spaced apart from each other by a distance commensurate with one print cycle (a distance commensurate with a print resolution). All of the flushing dot candidates for the respective inkjet heads 1 are included in the corresponding flushing pattern F1*a* in the flushing pattern group F1.

Figure 7:
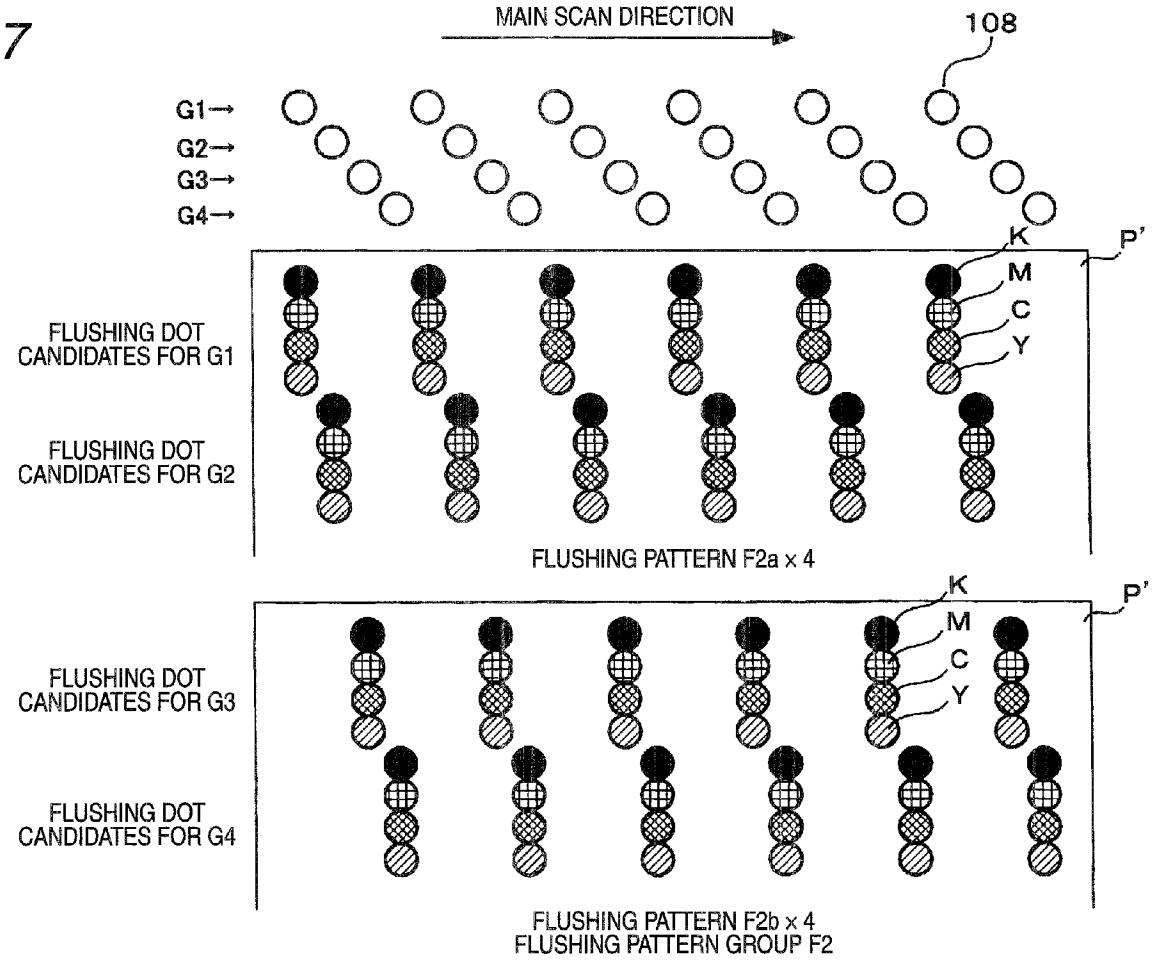
FIG. 7 is a schematic view of a bottom area representing the flushing pattern stored in a flushing data storage section shown in FIG. 5.

As shown in FIG. 7, the flushing pattern group F2 includes two flushing patterns F2*a* and F2*b* for each of the inkjet heads 1. In FIG. 7, the flushing patterns F2*a* and F2*b* for the four inkjet heads 1 are shown in a superimposed manner. In the flushing patterns F2*a* for the respective inkjet heads 1, the flushing dot candidates corresponding to the respective ejection ports 108 belonging to single ejection port group G1 and 82 are arranged in one line along the main scan direction. Rows of two flushing dot candidates corresponding to two ejection port groups G1 and G2 are sequentially arranged from up to down in the drawing. In the flushing patterns F2*b* for the respective inkjet heads 1, the flushing dot candidates corresponding to the respective ejection ports 108 belonging to single ejection port group G3 and G4 are arranged in one line along the main scan direction. Rows of two flushing dot candidates corresponding to two ejection port groups G3 and G4 are sequentially arranged from up to down in the drawing. Rows of flushing dot candidates for the same ejection port groups G1 to G4 of the four inkjet heads 1 are arranged along the conveyance direction of the sheet P. Sequence of arrangement of four rows is black, magenta, cyan, and yellow from up to down in the drawing. Specifically, the four flushing dot candidates corresponding to the ejection ports 108 located at the same position in the main scan direction of the respective inkjet heads 1 are located at different positions in the conveyance direction of the sheet P. In the flushing pattern group F2, all of the flushing dot candidates of the respective inkjet heads 1 are divided into two; namely, flushing dot candidates making up the flushing patterns F2*a* and flushing dot candidates making up the flushing patterns F2*b*. In this case, the two groups of flushing dot candidates include the same number of flushing dot candidates.

Figure 8:
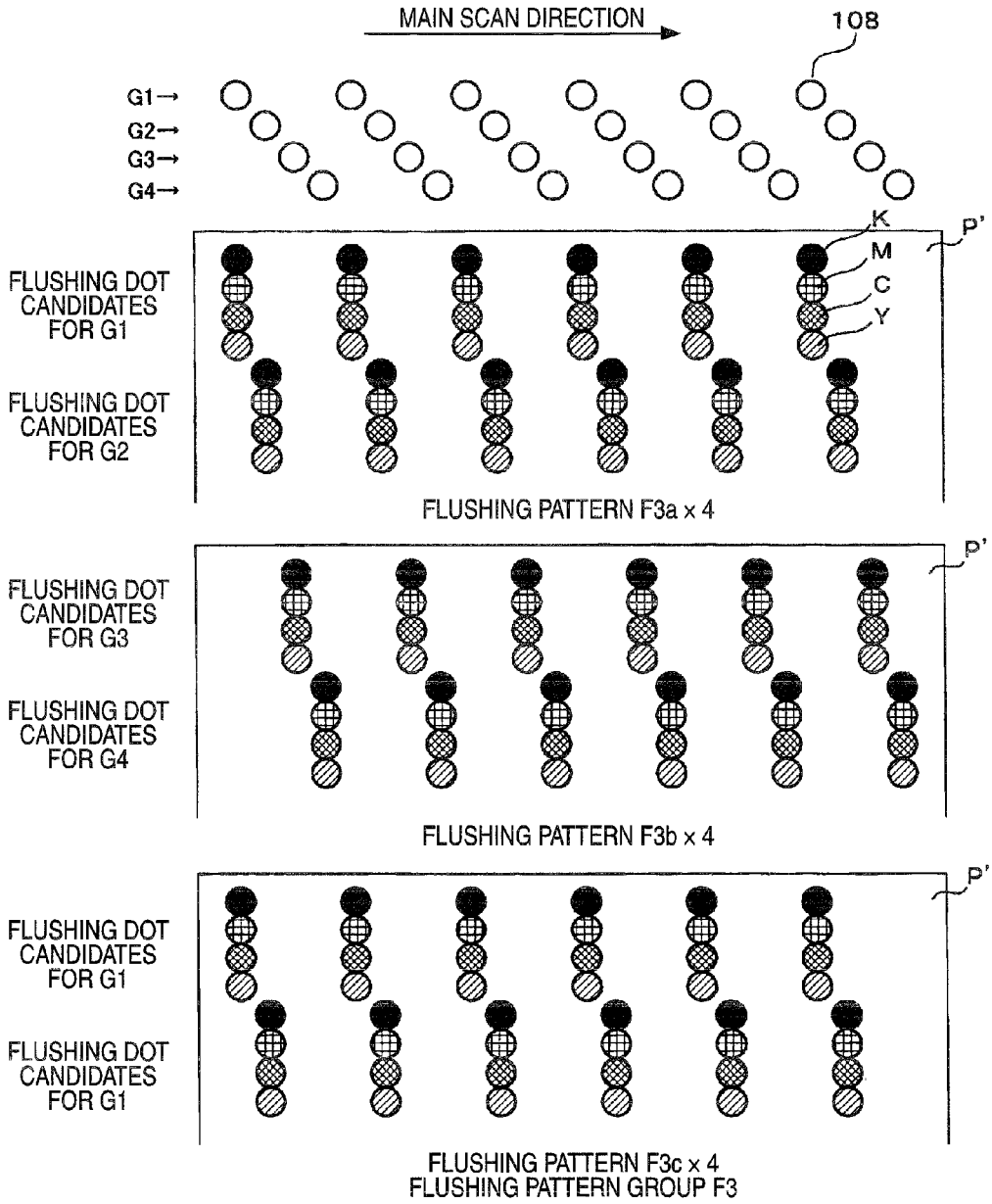
FIG. 8 is a schematic view of a bottom area representing the flushing pattern stored in a flushing data storage section shown in FIG. 5.

As shown in FIG. 8, the flushing pattern group F3 includes three flushing patterns F3*a* to F3*c* for the respective inkjet heads 1. The flushing patterns F3*a* and F3*c* are identical with the flushing patterns F2*a*, and the flushing patterns F3*b* are identical with the flushing patterns F2*b*. The flushing patterns F3*a* and F3*c* correspond to the ejection port groups G1 and G2, and the flushing patterns F3*b* correspond to the ejection port groups G3 and G4. In the flushing pattern groups F3, all of the flushing dot candidates of the respective inkjet heads 1 are divided into two; namely, flushing dot candidates making up the flushing patterns F3*a* and F3*c* and flushing dot candidates making up the flushing pattern F3*b*. Even in this case, the two groups of flushing dot candidates include the same number of flushing dot candidates.

Figure 9:
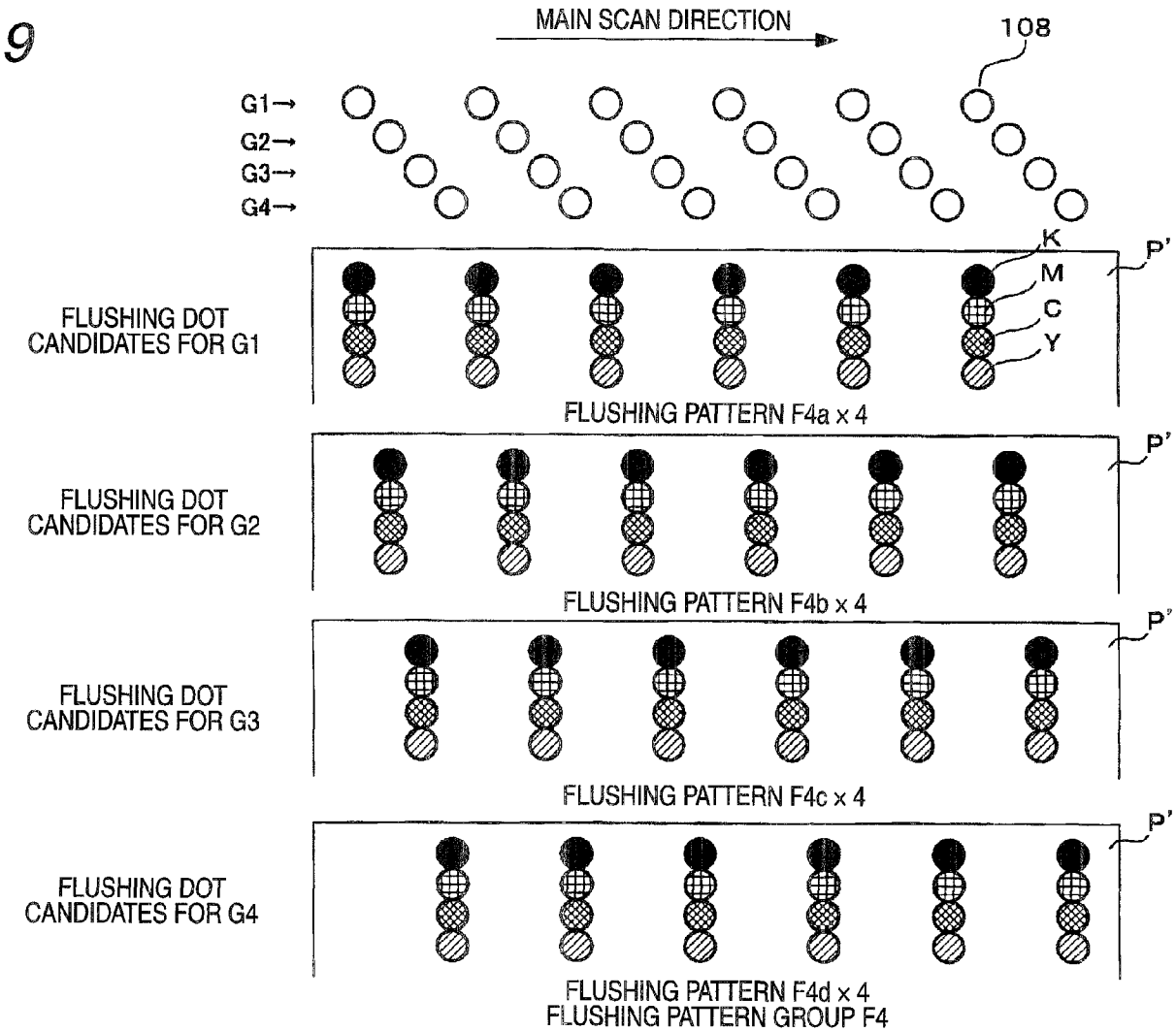
FIG. 9 is a schematic view of a bottom area representing the flushing pattern stored in a flushing data storage section shown in FIG. 5.

As shown in FIG. 9, the flushing pattern group F4 includes four flushing patterns F4*a* to F4*d* for the respective inkjet heads 1. FIG. 9 shows that the flushing patterns F4*a* to F4*d* for the four inkjet heads 1 are superimposed on each other. In the flushing patterns F4*a* pertaining to the respective inkjet heads 1, the flushing dot candidates corresponding to the respective ejection ports 108 of the ejection port group G1 are arranged along the main scan direction. In the flushing patterns F4*b* for the respective inkjet heads 1, the flushing dot candidates corresponding to the respective ejection ports 108 of the ejection port group G2 are arranged along the main scan direction. In the flushing patterns F4*c* for the respective inkjet heads 1, the flushing dot candidates corresponding to the respective ejection ports 108 of the ejection port group G3 are arranged along the main scan direction. In the flushing patterns F4*d* for the respective inkjet heads 1, the flushing dot candidates corresponding to the respective ejection ports 108 of the ejection port group G4 are arranged along the main scan direction. In the flushing pattern group F4, the flushing dot candidates corresponding to all of the ejection ports 108 for the respective inkjet heads 1 are divided into four groups; namely, the flushing dot candidates making up the flushing patterns F4*a*; the flushing dot candidates making up the flushing patterns F4*b*; the flushing dot candidates making up the flushing patterns F4*c*; and the flushing dot candidates making up the flushing patterns F4*d*. The four flushing patterns F4*a* to F4*d* include the same number of flushing dot candidates.

In the present embodiment, the flushing dot candidates included in the respective flushing patterns F1*a*, F2*a*, F2*b*, F3*a* to F3*c*, and F4*a* to F4*d* are arranged in neighborhoods of an upper end of the virtual sheet P'. However, the flushing dot candidates may also be arranged at arbitrary positions on the virtual sheet P'. In the present embodiment, each of the flushing patterns F2*a* and F2*b*, F3*a* to F3*c*, and F4*a* to F4*d* making up the flushing pattern groups F2 to F4 includes an aggregate of the same number of flushing dot candidates. From the viewpoint of uniform distribution of the flushing dots over the sheet P, a difference between flushing patterns in the respective flushing pattern groups in terms of the number of flushing dot candidates is preferably one or less.

Turning back to FIG. 5, the continual print count storage section 43 stores the number of prints to be continually be produced (hereinafter called a "continual print count") (the number of records) corresponding to the number of sheets P to be continually subjected to image printing. The conveyance control section 45 controls a motor M of the conveyance unit 20 such that the sheets P are continually conveyed by an amount corresponding to a continual print count stored in the continual print count storage section 43.

The head control section 44 controls ejection of ink droplets from the ejection ports 108 of the inkjet heads 1 through the control substrates 54 in such a way that the image dots and flushing dots are produced on respective conveyed sheets P.

Specifically, when printing is commenced, the head control section 44 selects the flushing pattern group F1 from the flushing data stored in the flushing data storage section 42 when the continual print count stored in the continual print count storage section 43 is one. When the continual print count is two, the flushing pattern group F2 is selected. When the continual print count is three, the flushing pattern group F3 is selected. When the continual print count is four or greater, the flushing pattern group F4 is selected.

Every time the conveyance unit 20 conveys the sheet P, the head control section 44 reads image data stored in the image data storage section 41 and sequentially reads the flushing patterns F1*a*, F2*a* and F2*b*, F3*a* to F3*c*, or F4*a* to F4*d* included in the selected flushing pattern groups F1 to F4. Specifically, when the continual print count is one, the head control section 44 reads the flushing pattern F1*a*. When the continual print count is two, the head control section sequentially reads the flushing pattern F2*a* and the flushing pattern F2*b*. When the continual print count is three, the head control section sequentially reads the flushing pattern F3*a*, the flushing pattern F3*b*, and the flushing pattern F3*c*. When the continual print count is four, the head control section sequentially roads the flushing pattern F4*a*, the flushing pattern F4*b*, the flushing pattern F4*c*, and the flushing pattern F4*d*. When the continual print count is five or more, the head control section 44 repeatedly reads the flushing patterns F4*a* to F4*d*.

Figure 10:
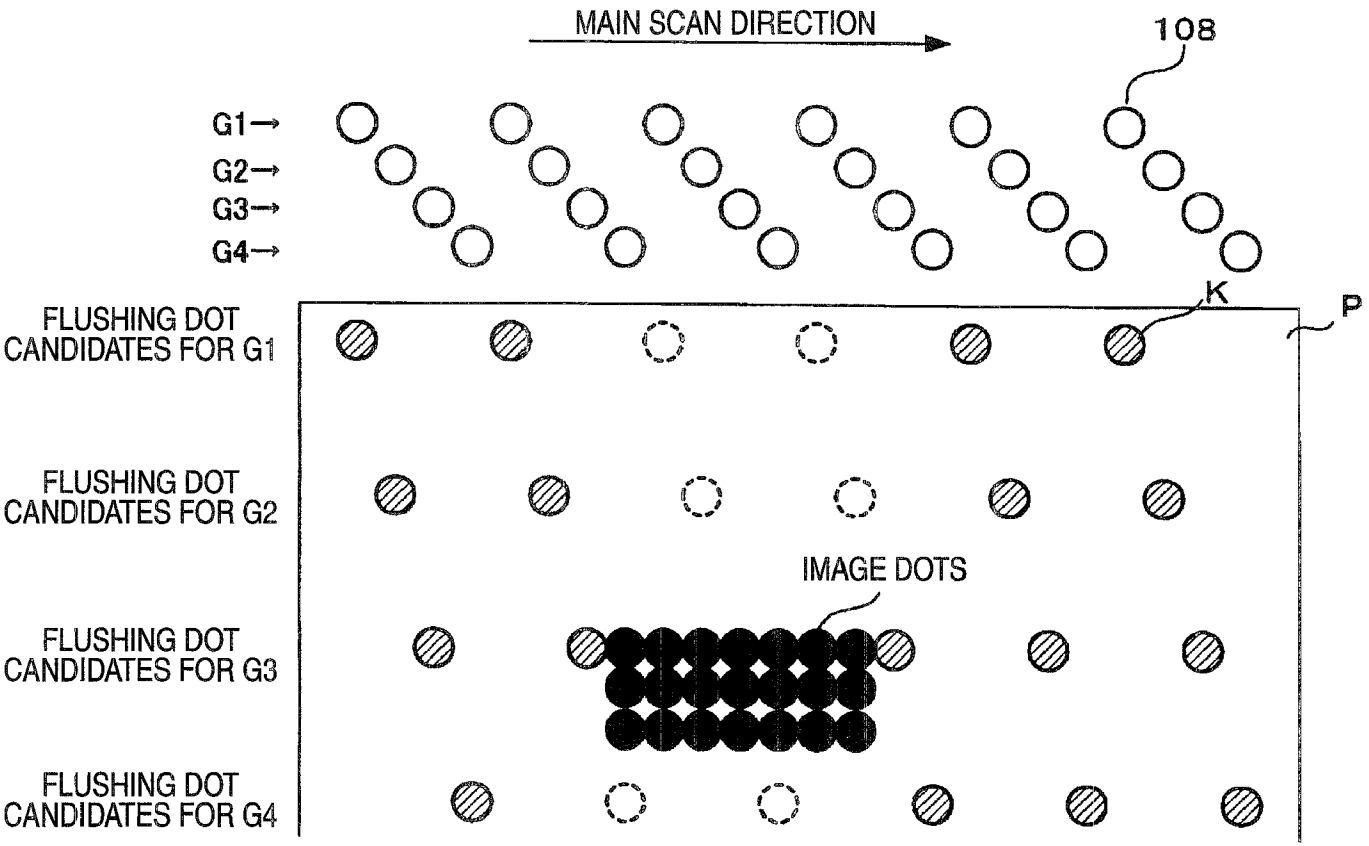
FIG. 10 shows an example print result for describing operation of a head control section shown in FIG. 5.

As shown in FIG. 10, the head control section 44 controls ejection of ink droplets from the ejection ports 108 of the respective inkjet heads 1 in such a way that image dots for the read image data are formed, and flushing dots corresponding to the flushing dot candidates, which are not located at the same positions on the virtual sheet P' where the image dots are located in the conveyance direction, among the flushing dot candidates for the thus-read flushing patterns F1*a*, F2*a* and F2*b*, F3*a* to F3*c*, and F4*a* to F4*d*, are formed. FIG. 10 shows only the black image dots and black flushing dots. When the continual print count is one, ink droplets are ejected at least once from all of the ejection ports 108 of the respective inkjet heads 1 before completion of printing of one sheet P. When the continual print count is two or three, ink droplets are ejected at least once from all of the ejection ports 108 of the respective inkjet heads 1 before completion of printing of the two sheets P. When the continual print count is four or more, ink droplets are ejected at least once from all of the ejection ports 108 of the respective inkjet heads 1 before completion of printing of the four sheets P.

An ejection completion count (a predetermined number) that is the number of prints required to let all of the ejection ports 108 of the respective inkjet heads 1 eject ink droplets regardless of contents of the image data is determined by a number by which the number of flushing dot candidates corresponding to all of the ejection ports 108 of all inkjet heads 1 are divided according to any of the flushing pattern groups F1 to F4. In the embodiment, the ejection complete count becomes maximum when there is selected the flushing pattern group F4 in which all of the flushing dot candidates are divided into four. The ejection complete count achieved at this time is four. The ejection completion count is a number equal to or less than the maximum number of sheets P (e.g., 10) conveyed by the conveyance unit 20 within a period of time during which speed of the ink droplet ejected from the ejection port 108 decreases from standard speed to a predetermined percentage of the standard speed, as a result of liquid in the ejection port 108 being degraded by drying, or the like.

Figure 11:
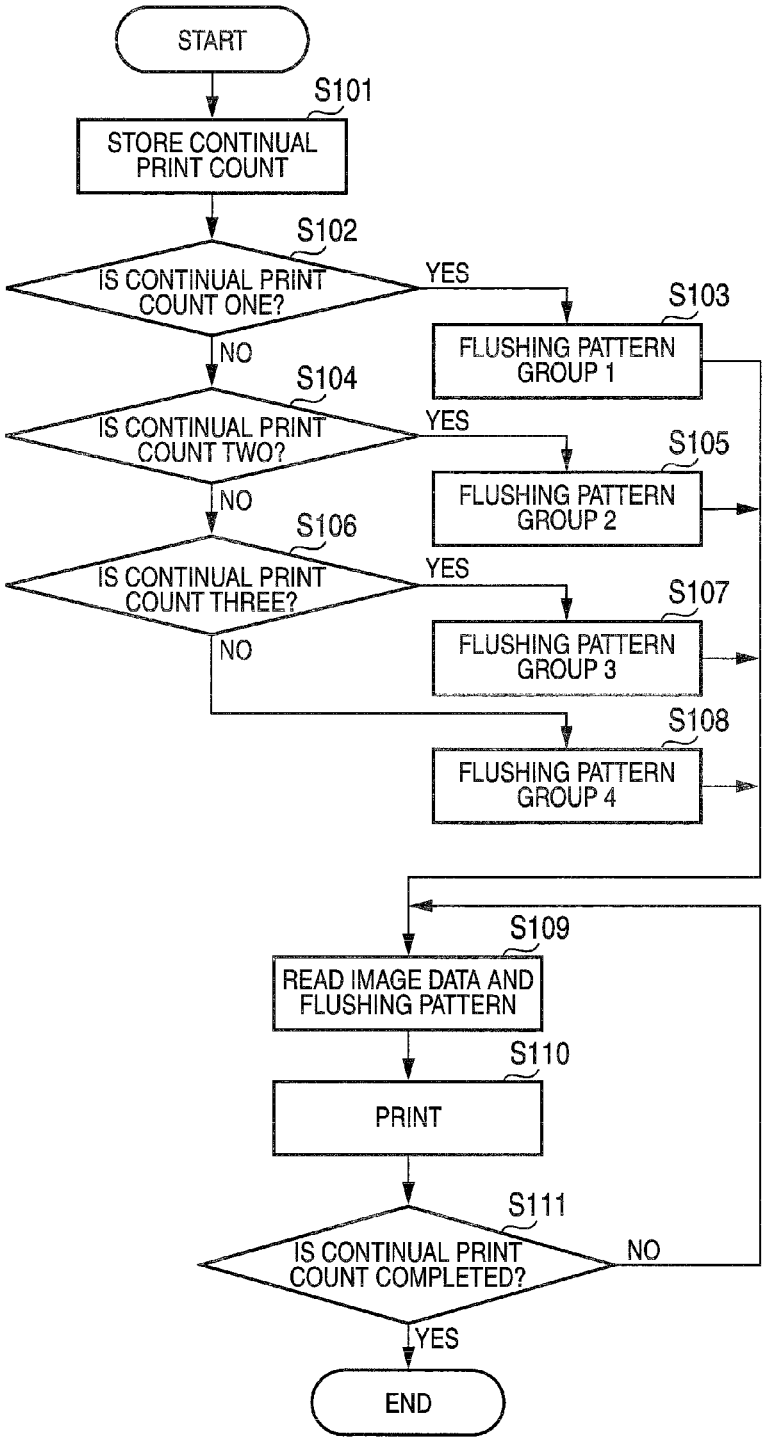
FIG. 11 is a flowchart showing operation procedures of a controller shown in FIG. 5.

Operation procedures of the controller 16 are now described by reference to FIG. 11. As shown in FIG. 11, upon receipt of a print start command from a host computer, a continual print count is stored in the continual print count storage section 43 (step S101 that is hereinafter abbreviated as "S101," and the same also applies to other steps in the following descriptions). The head control section 44 determines whether or not the continual print count stored in the continual print count storage section 43 is one (S102). When the continual print count is one (YES in S102), the head control section 44 selects the flushing pattern group F1 from the flushing data stored in the flushing data storage section 42 (S103). When the continual record count is not one (NO in S102), the head control section 44 determines whether or not the continual print count is two (S104). When the continual record count is two (YES in S104), the head control section 44 selects the flushing pattern group F2 from the flushing data (S105). When the continual record count is not two (NO in S104), the head control section 44 determines whether or not the continual print count is three (S106). When the continual record count is three (YES in S106), the head control section 44 selects the flushing pattern group F3 from the flushing data (S107). When the continual record count is not three; namely, when the continual print count is four or more (NO in S106), the head control section 44 selects the flushing pattern group F4 from the flushing data (S108).

The head control section 44 subsequently reads the image data stored in the image data storage section 41 and reads the first flushing patterns F1*a*, F1*a*, F3*a*, and F4*a* included in the selected flushing pattern groups F1 through F4 (S109). The head control section 44 causes the ejection ports 108 of the respective inkjet heads 1 to eject ink droplets in such a way that image dots for the read image data are formed, and flushing dots corresponding to the flushing dot candidates on the virtual sheet P', which are not located at the same positions where the image dots are provided in the conveyance direction, among the flushing dot candidates of the read flushing patterns F1*a*, F2*a*, F3*a*, and F4*a*, are formed, thereby subjecting the first sheet P conveyed to the conveyance unit 20 to printing (S110).

The controller 16 determines whether or not the continual print counts of the sheets P have finished undergoing printing (S111). When the continual print counts of the sheets P have not yet finished undergoing printing, the head control section 44 reads the image data stored in the image data storage section 41; reads the next flushing patterns F2*b*, F3*b*, and F4*b* included in the selected flushing pattern groups F1 through F4 (S109), whereupon the next sheets P are subjected to printing (S110). Processing is iterated before completion of printing of the continual print counts of the sheets P. Processing pertaining to the flowchart shown in FIG. 11 is completed when printing of the continual print counts of the sheets P is completed.

As mentioned above, the inkjet heads 1 of the present embodiment enable formation of image dots and flushing dots on the continual print counts of the sheets P. As a result, concentrated formation of the flushing dots on a specific sheet P is prevented, so that print quality of the sheets P can be made uniform. Since ink droplets are ejected from the respective ejection ports 108 to the sheet P before the viscosity of ink in the ejection ports 108 is increased. It is therefore possible to prevent occurrence of a change in ink ejection characteristic or an ejection failure without involvement of wasteful consumption of the sheets P.

Since the flushing dots are produced on the sheet P in accordance with the flushing pattern previously stored in the flushing data storage section 42, control operation for producing flushing dots becomes simple.

In the flushing pattern groups F2 through F4, the respective flushing patterns F2*a* and F2*b*, F3*a* to F3*c*, and F4*a* to F4*d* include aggregates of the same number of flushing dot candidates. Therefore, it is possible to make print quality of the sheets P uniform when a plurality of sheets are continually printed.

In addition, in the respective flushing pattern groups F2 through F4, each of the flushing patterns F2*a* and F2*b*, F3*a* to F3*c*, and F4*a* to F4*d* includes the number of flushing dot candidates that is determined by dividing the number of flushing dot candidates corresponding to all of the ejection ports 108 for all of the inkjet heads 1 by the maximum number or less. Hence, the number of flushing dot candidates can be reduced while an increase in viscosity of ink in the ejection ports 108 is prevented. It is further possible to prevent deterioration of print quality, which would otherwise be caused by a decrease in the number of flushing dots to be formed on the sheet P, and cut back on power and ink consumption for producing the flushing dots.

Further, each of the flushing patterns F1*a*, F2*a*, F2*b*, F3*a* to F3*c*, and F4*a* to F4*d* is made by combination of flushing dot candidates corresponding to at least any of the four ejection port groups G1 to G4 made up of the ejection ports 108 selected in groups of four from one end in the main scan direction. Therefore, the flushing dot candidates can be well distributed in the main scan direction. The flushing dots become thereby less easy to recognize, so that deterioration of print quality can be hindered.

When the continual print count is five or more, the head control section 44 repeatedly reads the flushing patterns F4*a* to F4*d*. Therefore, even when the continual print count exceeds the maximum number, it is possible to prevent occurrence of an increase in viscosity of ink in the ejection ports.

Since the flushing data include the flushing patterns F1*a*, F2*a*, F2*b*, F3*a* to F3*c*, and F4*a* to F4*d* by means of which the four flushing dot candidates corresponding to the ejection ports 108 of the inkjet heads 1 located at the same position in the sub-scan direction are produced at different locations in the conveyance direction of the sheet P, the flushing dots do not overlap each other on the sheet P. It is possible to prevent an increase in the area of the flushing dots.

First Example Modification

In the foregoing embodiment, the flushing dots are configured so as to be produced in accordance with the flushing patterns F1*a*, F2*a* and F2*b*, F3*a* to F3*c*, and F4*a* to F4*d* included in the flushing pattern groups F1 to F4 selected by the continual print count. However, the flushing dots may also be produced in accordance with arbitrary flushing patterns, so long as ink droplets can be ejected from all of the ejection ports 108 before the viscosity of ink in the ejection ports 108 is increased; namely, before the maximum number of sheets P are conveyed by the conveyance unit 20.

For instance, flushing dots based on the flushing pattern Fa1 can also be produced on the first conveyed sheet P regardless of a continual print count. In this case, since all of the ejection ports 108 eject ink droplets at least once before completion of printing of the first conveyed sheet P regardless of the continual print count, it is thereby possible to prevent an increase in viscosity of ink in the ejection ports 108 without fail. When the continual print count is the maximum number of sheets or more, all you need is to produce flushing dots in accordance with the flushing pattern F1*a* at each predetermined number of sheets that is equal to or less than the maximum number of sheets.

Flushing dots can also be produced on all of the sheets P in accordance with the flushing pattern Fa1. In this case, ink droplets are ejected at least once from all of the ejection ports 108 before completion of printing of the sheets P. Hence, it is possible to reliably prevent occurrence of an increase in viscosity of ink in the ejection ports 108 more reliably.

Second Example Modification

Figure 12:
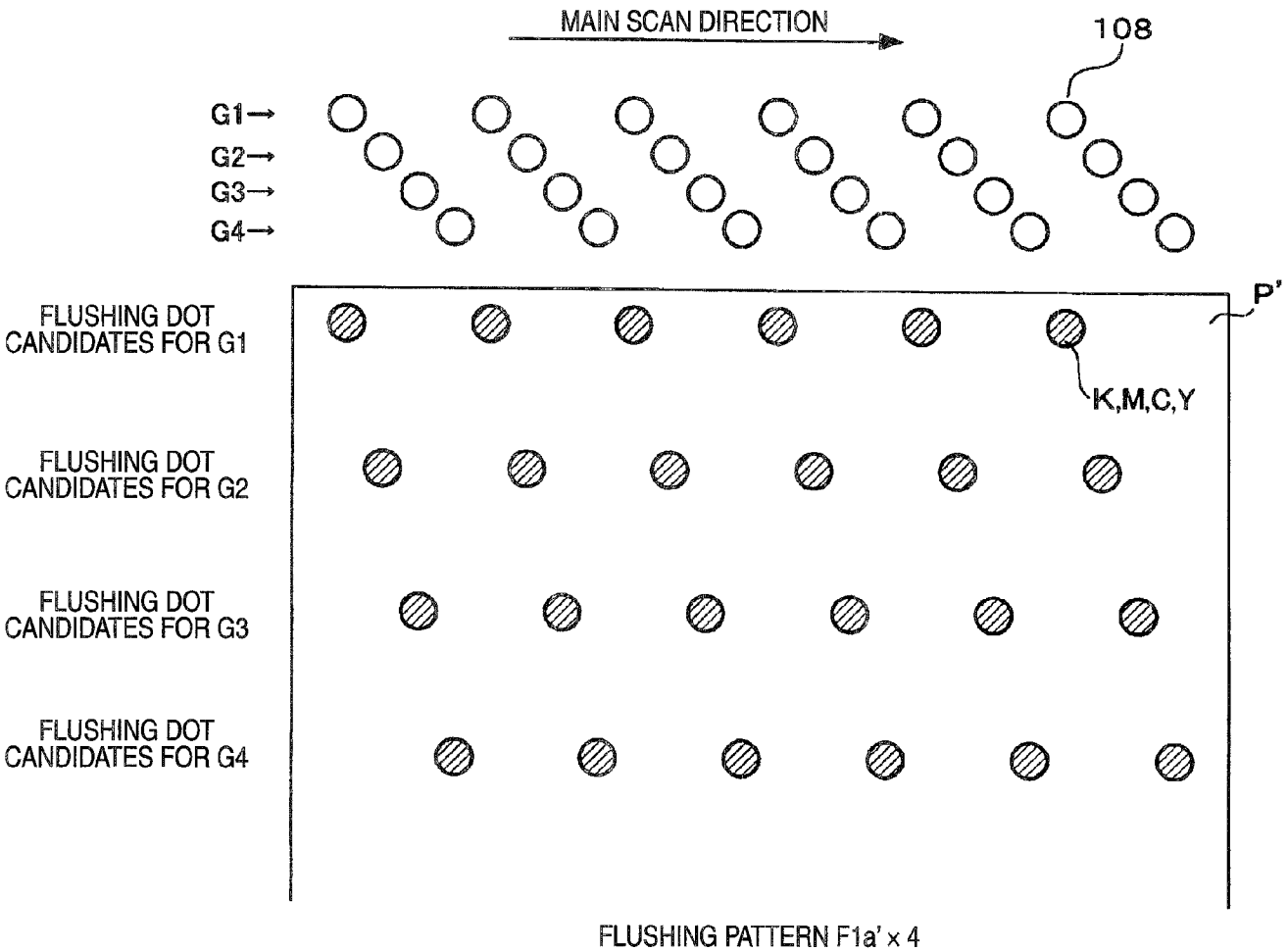
FIG. 12 is a schematic diagram of the flushing pattern of an example modification.

In the foregoing embodiment, the flushing data are configured so as to include the flushing patterns F1*a*, F2*a* and F2*b*, F3*a* to F3*c*, and F4*a* to F4*d* by means of which the four flushing dot candidates corresponding to the ejection ports 108 of the respective inkjet heads 1 located at the same position with respect to the sub-scan direction are formed at mutually-different positions along the conveyance direction of the sheet P. As shown in FIG. 12, flushing data may also include flushing patterns by means of which four flushing dot candidates are formed at the same location with respect the conveyance direction of the sheet P. As a result, the number of flushing dots produced on the sheet P is reduced, and hence deterioration of print quality can be prevented.

In any of the embodiments, the quantity of ink droplets ejected according to the flushing data is set to a quantity that is smaller than the quantity of a small droplet for an image dot in terms of dots on the sheet P being made less conspicuous. The essential requirement is that droplets should be ejected during flushing operation, and hence the minimum quantity of droplets that can be ejected may also be adopted.

Although the preferred embodiments of the present invention have been described thus far, the present invention is not limited to the foregoing embodiments and susceptible to various modifications within the scope of appended claims. Although the foregoing embodiment is configured in such a way that predetermined flushing data are stored in the flushing data storage section 42, the embodiment may also be configured in such a way that flushing data are produced every time printing of one or a plurality of sheets P is started.

In the foregoing embodiment, the flushing pattern groups F2 to F4 are configured such that a difference between the flushing patterns F2*a* and F2*b*, F3*a* to F3*c*, and F4*a* to F4*d* in terms of the number of flushing dot candidates comes to one or less. The difference between the respective flushing patterns in terms of the number of flushing dot candidates can also come to two or more.

In the foregoing embodiment, the respective flushing patterns F1*a*, F2*a* and F2*b*, F3*a* to F3*c*, and F4*a* to F4*d* are configured so as to be formed from combinations of flushing dot candidates corresponding to at least any of the four ejection port groups G1 to G4 made up of the ejection ports 108 selected in groups of four from one end in the main scan direction. However, positions of the flushing dot candidates in the respective flushing patterns may also be at arbitrary positions in the sub-scan direction.

In addition, the present embodiment is configured so as to be able to produce flushing dots on all of the sheets P to be printed. However, the embodiment can also be configured such that flushing dots are not produced on the maximum number of sheets P after all of the ejection ports 108 have ejected ink droplets. Ink consumption can thereby be cut back further.

When the continual print count is three, the flushing pattern F3*a*, the flushing pattern F3*b*, and the flushing pattern F3*c* are selected in this sequence, and flushing dots are produced in the same pattern on the first and third sheets. There is no necessity for keeping the sequence at all times. A pattern to be repeated may also become the flushing pattern F3*a* (F3*c*) and the flushing pattern F3*b*. In this case, the type of the pattern repeated during preceding print processing is stored. A pattern differing from the thus-stored type of pattern is set as a first flushing pattern during subsequent print processing. Occurrence of a difference between nozzle groups in terms of a flushing effect is prevented.

When the continual print count is five or more, flushing dots are produced by means of any of the flushing patterns F4*a* to F4*d* after the four flushing patterns F4*a* to F4*d* have completed at least a full circle, whereupon a series of print processing operations are completed. The finally-selected pattern during preceding print processing is stored at this time. A pattern subsequent to the thus-stored pattern may also be set as the first flushing pattern at the time of the next processing. A difference between the nozzle groups in terms of a flushing effect is thereby be eliminated.

The explanations have been provided to the case where a piezoelectric element is used for the actuator, but the present invention is applicable regardless of the type of the actuator. For instance, a static actuator, an actuator for causing ejection of ink droplets by air bubbles produced by heating, and the like, fall within an applicable range.

The present invention is also applicable to a recording apparatus that ejects liquid other than ink. Further, the present invention is not limited to the printer but may also be applied to a facsimile, a copier, and the like.

What is claimed is:

1. A recording apparatus comprising:

a conveyance mechanism which conveys a recording medium in a conveyance direction;

a liquid ejection head including a plurality of ejection ports that eject droplets to the recording medium conveyed by the conveyance mechanism;

a drive data storage which stores drive data for allocating, to the plurality of ejection ports, amounts of liquids to be ejected for producing an image on the recording medium every recording cycle which is a time required to convey by the conveyance mechanism the recording medium by a unit distance commensurate with a print resolution of the recording medium in the conveyance direction;

a record count storage which stores a record count that is number of recording mediums on which images are to be produced by the liquid ejection head;

a conveyance controller which controls the conveyance mechanism in such a way that recording mediums equal in number to the record count stored in the record count storage are continually conveyed; and a head controller which controls ejection of liquid from the liquid ejection head in accordance with the drive data stored in the drive data storage in such a way that one or a plurality of image dots, which makes up the image, are formed on the recording mediums conveyed by the conveyance mechanism, and which controls ejection of liquid from the liquid ejection head in such a way that a flushing dot which does not make up the image is formed on at least one position in an area of each of the recording mediums and each of the plurality of ejection ports produces at least one image dot or flushing dot before recording of a predetermined number or less of recording mediums is completed, wherein the predetermined number is equal to or smaller than a maximum number of recording mediums that are conveyed by the conveyance mechanism within a period of time during which speed of droplets ejected from the ejection ports reduces from a standard speed to a predetermined percentage of the standard speed as a result of degradation of liquid in the ejection ports.

2. The recording apparatus according to claim 1 further comprising:

a flushing data storage which stores flushing data pertaining to flushing patterns made up of one or a plurality of flushing dot candidates capable of becoming the flushing dots in connection with each record medium, wherein the head controller controls ejection of liquid from the liquid ejection head in accordance with the flushing data and the drive data in such a way that the flushing dots are formed at a position where the image dot is not produced.

3. The recording apparatus according to claim 2, wherein, when the record count is plural, the flushing data storage stores the flushing data in which a difference between the respective flushing patterns in terms of the number of flushing dot candidates is one or less.

4. The recording apparatus according to claim 3, wherein the flushing data are data pertaining to the flushing patterns including the plurality of flushing dot candidates made by dividing all of the flushing dot candidates to a number equal to or less than the maximum number.

5. The recording apparatus according to claim 4, wherein the plurality of flushing dot candidates made by division comprise every n-th flushing dot candidates selected, along a direction orthogonal to the conveyance direction, from all of the flushing dot candidates, n being equal to or less than the maximum number.

6. The recording apparatus according to claim 3, wherein the flushing data pertaining to at least the recording medium on which the image is first produced is identical with the flushing data in the case that the record count is one.

7. The recording apparatus according to claim 2, wherein the flushing data storage stores a plurality of flushing pattern groups which have the different flushing patterns from each other and are different from each other in the number of the flushing patterns which makes up the corresponding flushing pattern group, and the head controller selects the flushing pattern groups from the flushing data storage so that a sum of the number of the flushing patterns included in the selected flushing pattern groups corresponds to the record count.

8. The recording apparatus according to claim 2, wherein the plural liquid ejection heads are provided; and the flushing data storage stores, for each of the plurality of liquid ejection heads, the flushing data pertaining to the plurality of flushing dot candidates of the plurality of liquid ejection heads that are located at the same position along the orthogonal direction but at mutually-different positions along the conveyance direction.

9. The recording apparatus according to claim 2, wherein the plural liquid ejection heads are provided; and the flushing data storage stores, for each of the plurality of liquid ejection heads, the flushing data pertaining to the plurality of flushing dot candidates of the plurality of liquid ejection heads that are located at the same position along the orthogonal direction and at the same positions along the conveyance direction.

10. The recording apparatus according to claim 1, wherein when the number of the recording mediums is less than the predetermined number, the head controller controls the ejection of the liquid so that each of the plurality of ejection ports produces at least one image dot or flushing dot before the recording of the recording medium is completed.

11. The recording apparatus according to claim 1, wherein when the number of the recording medium is equal to or larger than the predetermined number, the head controller controls the ejection of the liquid so that at least one of the plurality of the ejection ports does not produce at least one image dot or flushing dot at the time the recording of less than the predetermined number of the recording medium is completed.

12. The recording apparatus according to claim 2, wherein the flushing data are data pertaining to the flushing patterns including the plurality of flushing dot candidates made by dividing all of the flushing dot candidates to a number equal to or less than the maximum number, and the head controller forms flushing dots on the predetermined number or more of the recording medium based on the flushing data in which all of the flushing dot candidates are divided to the maximum number.

13. A recording apparatus comprising:

an image data storage section which stores image data;

a flushing data storage section which stores a plurality of flushing pattern groups which have different flushing patterns from each other;

a continual print count storage section stores a continual print count that is number of recording mediums on which images are to be produced by a liquid ejection head; and a controller which selects at least one of the flushing pattern groups stored in the flushing data storage section according to the continual print count stored in the continual print count storage, and controls a printing head to eject ink droplets in such a way that each of a plurality of ejection ports of the liquid ejection head produces at least one image dot or flushing dot based on the image data stored in the image data storage section and the selected at least one of the flushing pattern groups before recording on the recording mediums of a predetermined number or less is completed.

14. The recording apparatus according to claim 13, wherein each of the flushing pattern groups includes at least one flushing pattern for each recording medium.

15. The recording apparatus according to claim 13, wherein a number of flushing patterns included in the respective flushing pattern groups are different from each other.

16. The recording apparatus according to claim 13, wherein the controller selects plural sets of the flushing pattern groups in combination according to the continual print count.

* * * * *